US011265978B2

(12) United States Patent
Takagi et al.

(10) Patent No.: US 11,265,978 B2
(45) Date of Patent: Mar. 1, 2022

(54) DISCHARGE LAMP LIGHTING CONTROL APPARATUS AND LAMP CURRENT SUPPLY METHOD

(71) Applicant: Sansha Electric Manufacturing Co., Ltd., Osaka (JP)

(72) Inventors: Toshiki Takagi, Osaka (JP); Kazuhiro Nishikawa, Osaka (JP)

(73) Assignee: Sansha Electric Manufacturing Co., Ltd., Osaka (JP)

( * ) Notice: Subject to any disclaimer, the term of this patent is extended or adjusted under 35 U.S.C. 154(b) by 11 days.

(21) Appl. No.: 16/309,493

(22) PCT Filed: May 31, 2018

(86) PCT No.: PCT/JP2018/020918
§ 371 (c)(1),
(2) Date: Dec. 13, 2018

(87) PCT Pub. No.: WO2019/064695
PCT Pub. Date: Apr. 4, 2019

(65) Prior Publication Data

US 2021/0227653 A1 Jul. 22, 2021

(30) Foreign Application Priority Data

Sep. 28, 2017 (JP) ..... JP2017-188612

(51) Int. Cl.
*H05B 41/36* (2006.01)
*H05B 45/3578* (2020.01)
*H05B 7/00* (2006.01)

(52) U.S. Cl.
CPC ..... *H05B 41/36* (2013.01)

(58) Field of Classification Search
CPC ..... H05B 41/36; H05B 41/3928; H05B 45/3578; H05B 7/00; H05B 7/144;
(Continued)

(56) References Cited

U.S. PATENT DOCUMENTS 5,500,792 A 3/1996 Jeon
7,282,865 B2 10/2007 Van Casteren
(Continued)

FOREIGN PATENT DOCUMENTS

CN 1458813 A 6/2007
CN 1989788 A 6/2007
(Continued)

OTHER PUBLICATIONS

International Search Report and Written Opinion for corresponding International Application No. PCT/JP2018/020918, dated Aug. 14, 2018.

*Primary Examiner* — Wei (Victor) Y Chan
(74) *Attorney, Agent, or Firm* — Renner, Otto, Boisselle & Sklar, LLP

(57) ABSTRACT

Realizing a constant-current control even in a stable state of a lamp without increasing a rated output of a power supply. In a stable state of the lamp in which a change value of a lamp voltage after a discharge lamp is turned on becomes less than a certain value, when the lamp voltage rises, a discharge lamp lighting control apparatus changes a current command value to perform a constant-current control. This change is a change from a first current command value at the time when the discharge lamp is turned on to a second current command value that is smaller than the former by a predetermined value. Using this second current command value, the constant-current control is performed. Even after that, the second current command value is changed to a smaller value every time the lamp voltage rises, and the constant-current control is performed using the second current command value.

3 Claims, 12 Drawing Sheets

(58) Field of Classification Search
CPC . H05B 7/16; H05B 7/18; H05B 7/185; H05B 7/20; H05B 7/22; H05B 31/26; H05B 41/00; H05B 41/2806; H05B 41/288; H05B 45/39; H05B 6/681
See application file for complete search history.

(56) References Cited

U.S. PATENT DOCUMENTS

| | | | | |
|---|---|---|---|---|
| 2003/0214253 | A1 | 11/2003 | Okamoto et al. | |
| 2005/0062432 | A1 | 3/2005 | Van Casteren | |
| 2008/0048586 | A1 | 2/2008 | Hasegawa et al. | |
| 2008/0315790 | A1 | 12/2008 | Ikeda | |
| 2009/0278469 | A1* | 11/2009 | Yamada ..... | G03B 21/2053 315/291 |
| 2012/0049764 | A1* | 3/2012 | Yamamoto ..... | H05B 41/388 315/307 |

FOREIGN PATENT DOCUMENTS

| | | | |
|---|---|---|---|
| CN | 10790900 | A | 7/2010 |
| CN | 102379161 | A | 3/2012 |
| CN | 103369806 | A | 10/2013 |
| JP | 2005-032711 | A | 2/2005 |
| JP | 2005-515609 | A | 5/2005 |
| JP | 2006-73310 | A | 3/2006 |
| JP | 2008-235240 | A | 10/2008 |
| JP | 2012-160387 | A | 8/2012 |
| JP | 2016-136470 | A | 7/2016 |
| KR | 10-1021073 | | 9/2004 |
| TW | 302591 | A | 4/1997 |

* cited by examiner

【Pattern 1】t0～t1～t2

【Pattern 2】 t2～t3

【Pattern 3】 t3～

Fig.12

| | |
|---|---|
| First Current Command Value | Iref1 |
| Second Current Command Value | Iref2 (n) |
| Constant-Power Limiter | Wlmit |
| Lamp Voltage | Vdet (n) |
| Lamp Current | Idet (n) |
| Lamp Power Calculation Value | Wcal (n) |
| (Wcal (n) = Vdet (n) × Idet (n)) | |
| Control Cycle (CC) | T1 |
| Second Current Command Value Correction Cycle(2ndCC) | T2 |
| (Switching PWM Cycle << CC(T1) << 2ndCC(T2)) | |
| Time | t (n) |

※(n) Changes with Cycle T2

DISCHARGE LAMP LIGHTING CONTROL APPARATUS AND LAMP CURRENT SUPPLY METHOD

TECHNICAL FIELD

The present invention relates to a lighting control apparatus for a discharge lamp such as Xenon lamp or the like, and to a lamp current supply method for the same.

BACKGROUND ART

In discharge lamps such as xenon lamps and the like, in each tube thereof, there are provided two electrodes consisting of an anode and a cathode; and after the lamp is turned on an arc discharge occurs between the electrodes when a breakdown takes place caused by an igniter or the like. Brightness of the lamp is proportional to a magnitude of a lamp current that results from the arc discharge, and a lamp voltage depends on a distance between the electrodes and a state of a gas in the discharge lamp.

On the other hand, in a discharge lamp lighting control apparatus, in order to keep the brightness of the discharge lamp constant, a constant-current control is performed over the lamp current. Further, in this control apparatus, a constant-power control is also performed through setting of a power limit value (limiter) so that an output power of a power supply portion may not exceed a rated value.

For example, in Patent Literature 1 which is a prior art, a constant-current control is performed at a lamp turn-on stage where the lamp voltage is low, and a constant-power control is performed when the lamp voltage rises up to a certain value to reach a rated power.

When the discharge lamp is turned on, the lamp voltage rises as the state of the gas in the lamp is unstable in an initial state, and then a rise change value of the lamp voltage decreases gradually. After that, as the state in the lamp stabilizes, the lamp voltage also stabilizes. At this stage, stable states of both the gas and the arc are maintained in the lamp. Nevertheless, a phenomenon such as fluctuation of an arc-path or the like is apt to arise; so that, a slight rise of the lamp voltage occurs accordingly. In a case where the lamp is brought under the constant-current control continuously from its initial lighting stage, if the rise value of the lamp voltage is large when the lamp voltage is somewhat high already, it follows that the output power of the power supply portion becomes large enough to exceed the rated value.

Thus, in the lighting control apparatus shown in the prior art, control mode is switched from the constant-current control mode to the constant-power control mode if the lamp voltage rises to reach the rated power after the discharge lamp is turned on.

In the constant-power control mode, since the output power of the power supply portion never exceeds the rated value, load to neither the lamp nor the power supply portion becomes excessive.

CITATION LIST

Patent Literature

[Patent Literature 1]

JP 2005-32711 A

SUMMARY OF INVENTION

Technical Problem

However, the conventional discharge lamp lighting control apparatus that performs both the constant-current control and the constant-power control as described above has problems as below.

In the constant-power control mode, if the lamp voltage rises due to changes of the state of the gas and/or the state of the arc in the lamp, a control circuit causes the lamp current to decrease so that the output power (lamp power) of the power supply portion may not exceed the power limit value (limiter value). At this time, since the lamp current decreases, the brightness of the lamp also changes accordingly. When the change occurs, whether periodically or non-periodically, it results in being sensed as so-called flicker phenomenon. For a while from the initial stage of the lamp lighting, because the lamp voltage changes drastically and periods of the flicker phenomenon are long, flickering is intense during this period of time. Therefore, in this period of time, the lamp is used after the lamp voltage stabilizes to some degree. Although the flicker phenomenon with very short periods occurs even when the lamp voltage stabilizes, such an occurrence does not cause a problem because it cannot be perceived by a human naked eye. However, when the flicker phenomenon with periods of a degree that can be sensed by a human naked eye occurs, it is perceived as flickering. This flickering can not only cause tired eyes, but also cause interference fringes when the lamp is used as a backlight for shooting.

The following is an explanation of the above-mentioned phenomenon that is made referring to FIG. 1-FIG. 3:

FIG. 1 shows a structure of a discharge lamp and an arc. FIG. 2 shows a voltage-current characteristic diagram of a discharge lamp lighting control apparatus that performs a constant-current control and a constant-power control. FIG. 3 shows a change of a lamp current in a case where the constant-current control is performed when inside of the lamp is in a stable state (waveform on the right side), and a change of the lamp current in a case where the constant-power control is performed when the inside of the lamp is in a similarly stable state (waveform on the left side).

In FIG. 1, the discharge lamp has an anode (+) and a cathode (−) that are placed facing each other in a tube. In a stable state, an arc current flows along a path A; however, it may change to a path B when the state in the lamp fluctuates. With the path B, since the current path becomes longer, the lamp voltage rises. In the constant-power control, the flicker phenomenon occurs when a change from A to B takes place within several 10 ms, as explained below.

FIG. 2 shows a characteristic diagram when the power limit value (limiter) of the lamp is set to Wlimit. In the initial stage of the lighting, the lamp voltage rises, and during this time the constant-current control is performed (point 'a' in FIG. 2). When the lamp power reaches a rated value at point 'b' in FIG. 2, the constant-power control is performed if the voltage rises thereafter. In the constant-current control, the state of the gas and the state of the arc in the lamp fluctuate, and the lamp voltage rises, so that the operating point tends to transition to point 'c' in the diagram. However, in the constant-power control, since the point 'c' would result in exceeding the power limit value (limiter), actual operating point comes to point 'd' on the constant-power characteristic curve.

When such a phenomenon occurs every several 10 ms, which can be detected by a naked eye, since the lamp current fluctuates periodically, it follows that this is observed by a naked eye as the flicker phenomenon. Such a flicker phenomenon is often observed in an early stage of the stable state of the lamp voltage.

FIG. 3 shows changes of the voltage and the current when the lamp is in a stable state with an expanded time axis range. The upper part of the diagram shows a voltage change, and the lower part shows a current change. Also, the left part of the diagram shows changes of the voltage and the current when the constant-power control is performed in the stable state of the lamp (direct current component removed). At the time of the constant-power control shown in the left part of the diagram, the arc current path changes from A to B (see FIG. 1) at P1, and the lamp current decreases due to the rise of the lamp voltage (point 'd' in FIG. 2), which results in the flicker phenomenon that is observed. On the other hand, changes of the voltage and the current when the constant-current control is performed instead of the constant-power control in the stable state of the lamp are shown by the right part of FIG. 3. Even when the arc path changes from A to B (see FIG. 1) at P2 and thus the lamp voltage rises, since the control is performed so as to keep the current constant, no current change occurs. Thus, no flicker phenomenon occurs. In this manner, with the constant-current control, even in the stable state, the flicker phenomenon can be prevented from occurring. However, as mentioned above, with the constant-current control, there is a problem that the output of the power supply increases and load to the lamp also increases and then the lamp is damaged when the output exceeds the rated value.

The present invention is directed to providing a discharge lamp lighting control apparatus capable of constant-current control even in a stable state of a lamp without increasing a rated output value of a power supply.

Solution to Problem

A discharge lamp lighting control apparatus of the present invention comprises:

an inverter circuit supplying a discharge lamp with a lamp current; and a control circuit that performs a constant-current control of the lamp current and outputs a current command value to perform the constant-current control to the inverter circuit, wherein the control circuit performs the constant-current control by changing the current command value to a smaller value in a stable state in which a rise change value of a lamp voltage becomes less than a certain value after the discharge lamp is turned on.

The control circuit performs a control in such a manner as to be capable of constant-current control by decreasing the current command value when the discharge lamp reaches a stable state. This makes it possible to prevent the lamp current from decreasing when the lamp voltage rises in the stable state.

In a preferred embodiment, the control circuit performs a constant-power control by which an output power becomes a constant power when the output power exceeds a predetermined power limiter value, and outputs a power command value to perform the constant-power control to the inverter circuit.

In a more preferred embodiment of the present invention, the control circuit performs the following control in the order shown below until the lamp voltage stabilizes after the discharge lamp is turned on:

(1) performing the constant-current control using a predetermined first current command value in a first state after the discharge lamp is turned on.

(2) performing the constant-power control at a stage of becoming a second state in which the output power exceeds the power limiter value due to a rise of the lamp voltage after the first state.

(3) performing the constant-current control using a second current command value that is smaller than the first current command value when the output power exceeds the power limiter value due to a rise of the lamp voltage, at a stage of becoming a third state in which a rise change value of the lamp voltage becomes less than a certain value after the second state.

(4) performing the constant-current control in the third state by changing the second current command value to a smaller value every time the output power exceeds the power limiter value due to a rise of the lamp voltage.

(5) performing the constant-current control when a fourth state in which the lamp voltage stabilizes commences after the third state, using the second current command value having been changed right before then.

When the discharge lamp is turned on, the lamp voltage starts to rise, and the constant-current control is performed based on a predetermined first current command value that is set beforehand by the user (first state). Thereafter, when the output power reaches the power limiter value, the constant-power control is performed (second state). After that, during the constant-power control, a stable state of the lamp in which the rise change value of the lamp voltage is less than a certain value commences (third state). In an early stage of the stable state of the lamp, the current command value is changed from the first current command value having been used until then to the second current command value that is smaller by a predetermined value than the former when the output power exceeds the power limiter value as a result of a rise of the lamp voltage by $\Delta V$ due to the fluctuation of the arc current path as shown in FIG. 1. Then, using this second current command value, the constant-current control is performed. Even after that, the second current command value is kept being changed to a smaller value every time the output power exceeds the power limiter value as a result of the rise of the lamp voltage by $\Delta V$. After the third state, when the fourth state in which the lamp voltage stabilizes commences, the constant-current control is performed using the second current command value having been changed right before then.

With the above-mentioned control, in the third state, the constant-current control is performed continuingly by making the second current command value smaller little by little depending on the rise of the lamp voltage. In the fourth state, as well, the constant-current control is performed. This means that from the third state onward the constant-current control is performed, unlike the constant-power control as in a conventional manner. Thus, even when the lamp voltage fluctuates due to arc shaking, there is no occurrence of the flickering phenomenon.

Moreover, since the current command value is decreased from the third state onward, there is no need to increase power capacity. Besides, since the power supplied to the lamp never becomes large, there is no risk of reducing the lamp service life.

In a furthermore preferred embodiment, in the third state, the control circuit carries out a change of the current command value gradually over a predetermined time.

By carrying out the change of the current command value gradually over a predetermined time, since such a command value change never becomes sudden, flicker generation is suppressed further.

Advantageous Effects of Invention

Even after the discharge lamp comes in the stable state, since the constant-current control is maintained, flicker generation can be prevented. Further, since there is no need to increase power capacity, it is possible to prevent the enlargement of the power supply portion; and also, there is no risk of reducing the lamp service life.

BRIEF DESCRIPTION OF DRAWINGS

FIG. 12 is a definition diagram.

DESCRIPTION OF EMBODIMENTS

Figure 4:
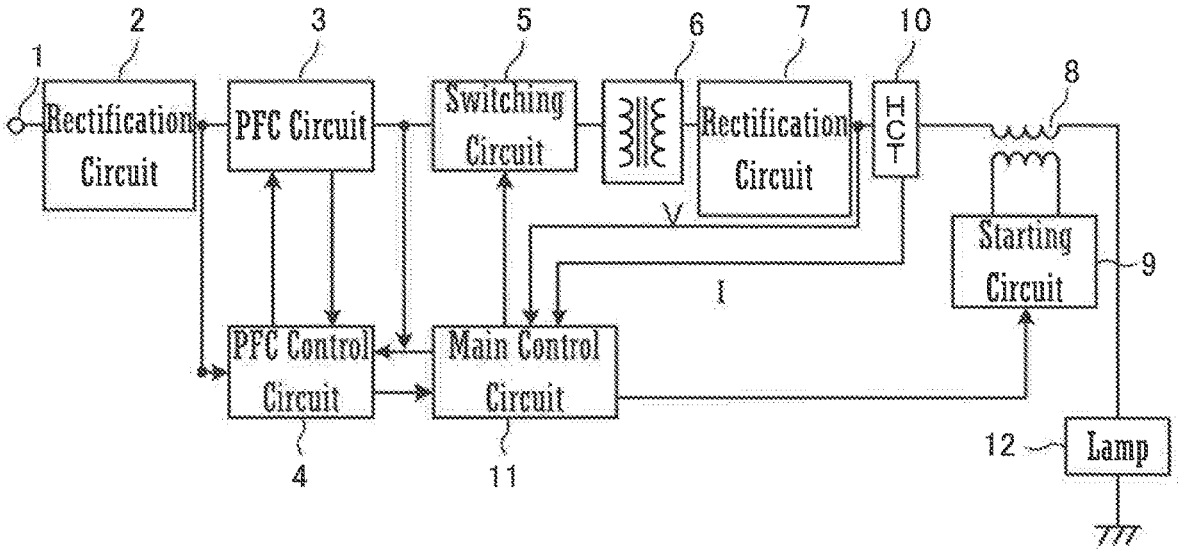
FIG. 4 is a block diagram of a discharge lamp lighting control apparatus.

FIG. 4 is a block diagram of a discharge lamp lighting control apparatus according to an embodiment of the present invention.

The discharge lamp lighting control apparatus includes: a first rectification circuit 2 for rectifying an AC voltage inputted to a commercial power supply input terminal 1; a PFC circuit (power factor improvement circuit) 3 for improving a power factor by modifying a current waveform of a rectification output from the first rectification circuit 2; a PFC control circuit 4 for controlling the PFC circuit 3; a switching circuit 5; a transformer for performing a voltage conversion of an output from the switching circuit 5; a second rectification circuit 7 for rectifying a voltage-transformed output; a high voltage transformer 8 and a starting circuit 9 that superimpose a turn-on high voltage pulse onto a rectification output from the second rectification circuit 7; a lamp current detector 10 for detecting an output current (lamp current); and a main control circuit 11 for supplying a control PWM signal to the switching circuit 5 that performs a constant-current control and a constant-power control based on the lamp current and a lamp voltage. A discharge lamp 12 such as xenon lamp or the like is connected to an output side of the high voltage transformer 8.

Figure 5:
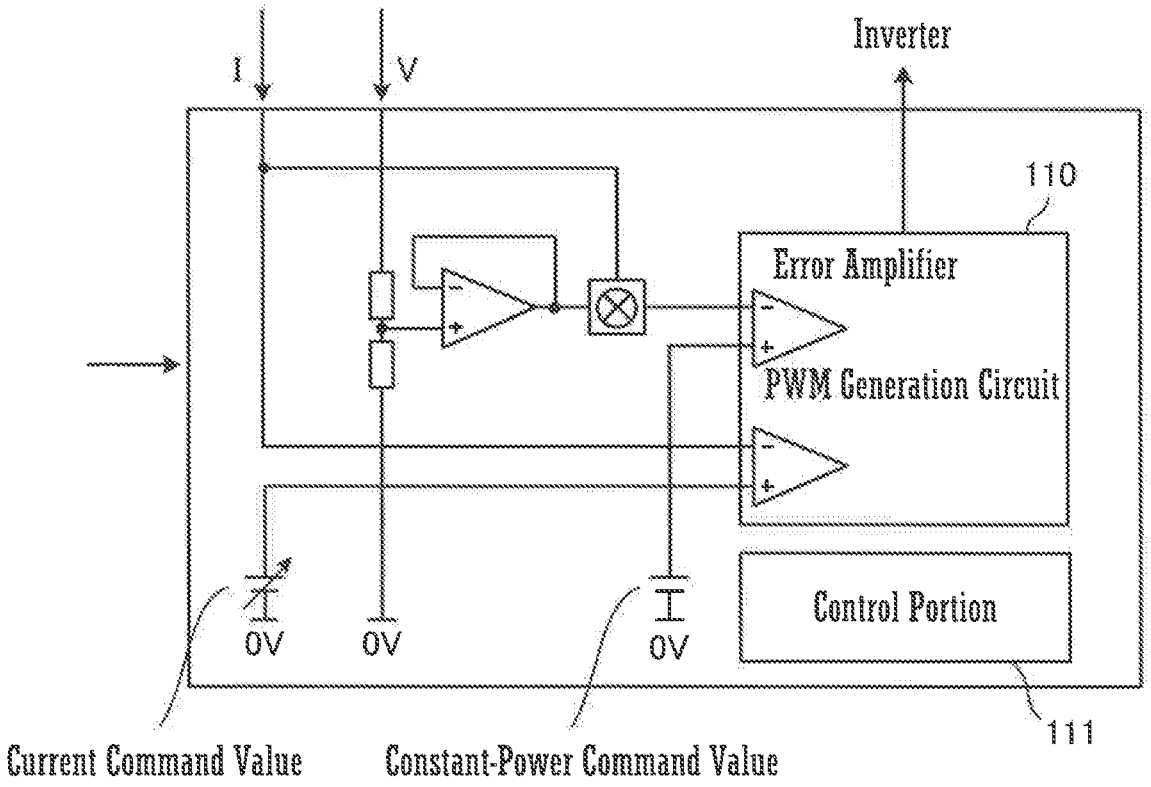
FIG. 5 is a block diagram of a main control circuit.

FIG. 5 is a block diagram of the main control circuit 11.

The main control circuit 11 inputs a difference between a detected lamp current I and a current command value and a difference between a lamp power and a power command value to an error amplifier in a PWM generation circuit 110. The PWM generation circuit 110 performs a constant-current control so as to cause the difference between the lamp current I and the current command value to become zero. Further, the PWM generation circuit 110 performs a constant-power control that decreases the output current so as to cause the difference between the lamp power and the power command value to become zero when the lamp power is about to exceed a power limiter value, namely, the power command value.

In the constant-current control and in the constant-power control, the PWM control is performed in both controls. The main control circuit 11 includes a control portion 111 that performs a control shown in a flow chart described later. Further, instead of the main control circuit 111, the PWM control may be performed using the arithmetic processing and/or a conversion table for the lamp current and the lamp voltage.

In this embodiment, the constant-current control is performed using a first current command value after the discharge lamp 12 is turned on (first state), and is switched over to the constant-power control when the lamp voltage V rises and an output power that is calculated from the first current command value and the lamp voltage V exceeds a predetermined power limiter value, e.g. a rated power (second state). In the constant-power control, when a rise change value of the lamp voltage V decreases gradually to move into a stable state of the lamp in which the lamp voltage V stabilizes, fluctuation of the lamp voltage is monitored (third state). When the third state is moved in, in an early stage of the stable state of the lamp, there is a period of time in which the lamp voltage V increases slightly. In this period of time, when the lamp voltage rises and the output power exceeds the power limiter value, the current command value is changed from the first current command value to a second current command value that is smaller by a predetermined value than the former. Using this second current command value, the constant-current control is performed. Further, even after that, the second current command value is changed to a smaller value every time the output power exceeds the power limiter value as a result of the rise of the lamp voltage, and the constant-current control is performed using the changed second current command value.

After the third state, when a fourth state in which the lamp voltage completely stabilizes commences, the constant-current control is performed using the second current command value having been changed right before then.

This means that after the third state onward the constant-current control is performed using the second current command value having been set most recently.

Figure 6:
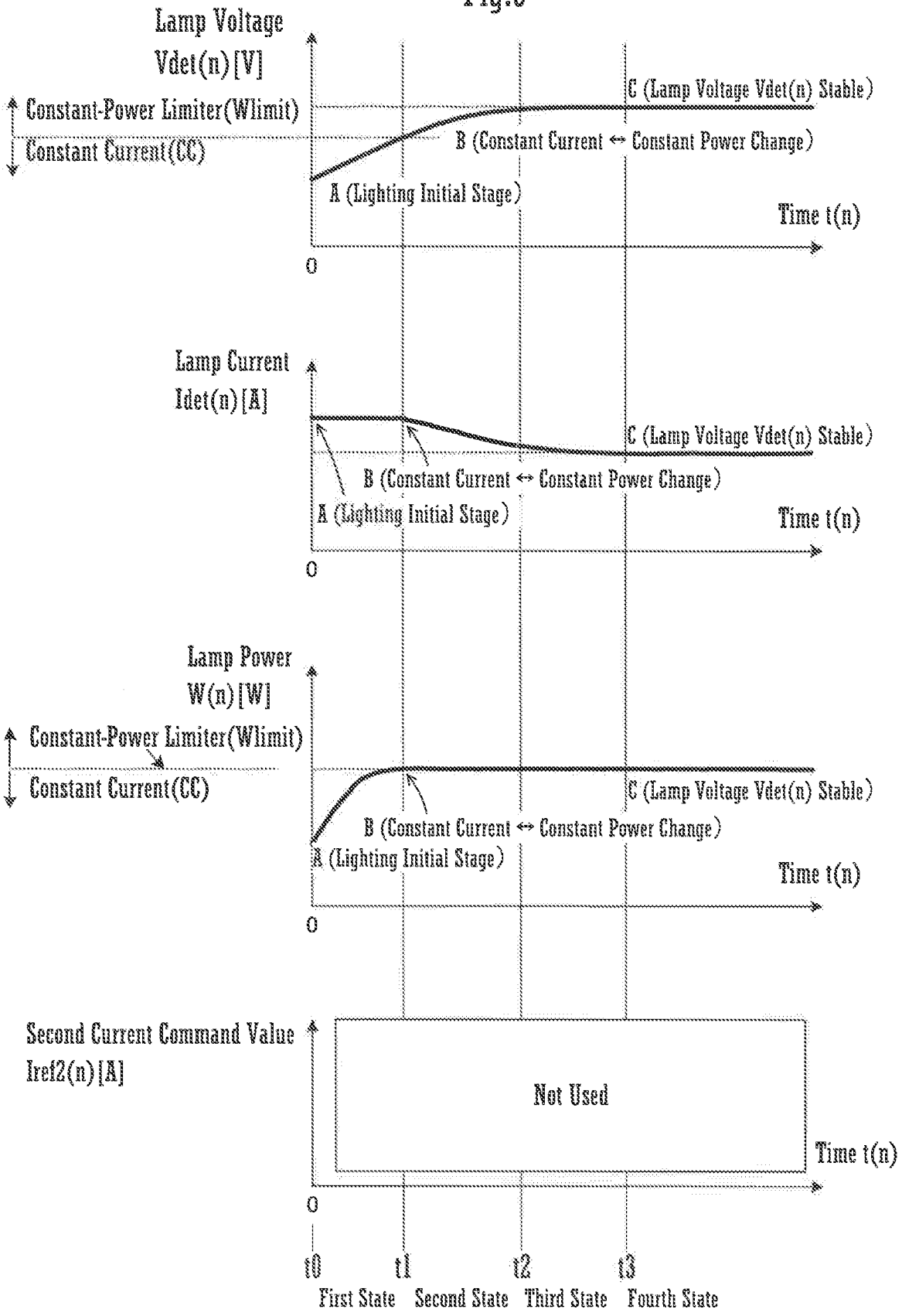
FIG. 6 is a diagram showing a time lapse of a lamp voltage and so forth in a conventional discharge lamp lighting control apparatus.
Figure 7:
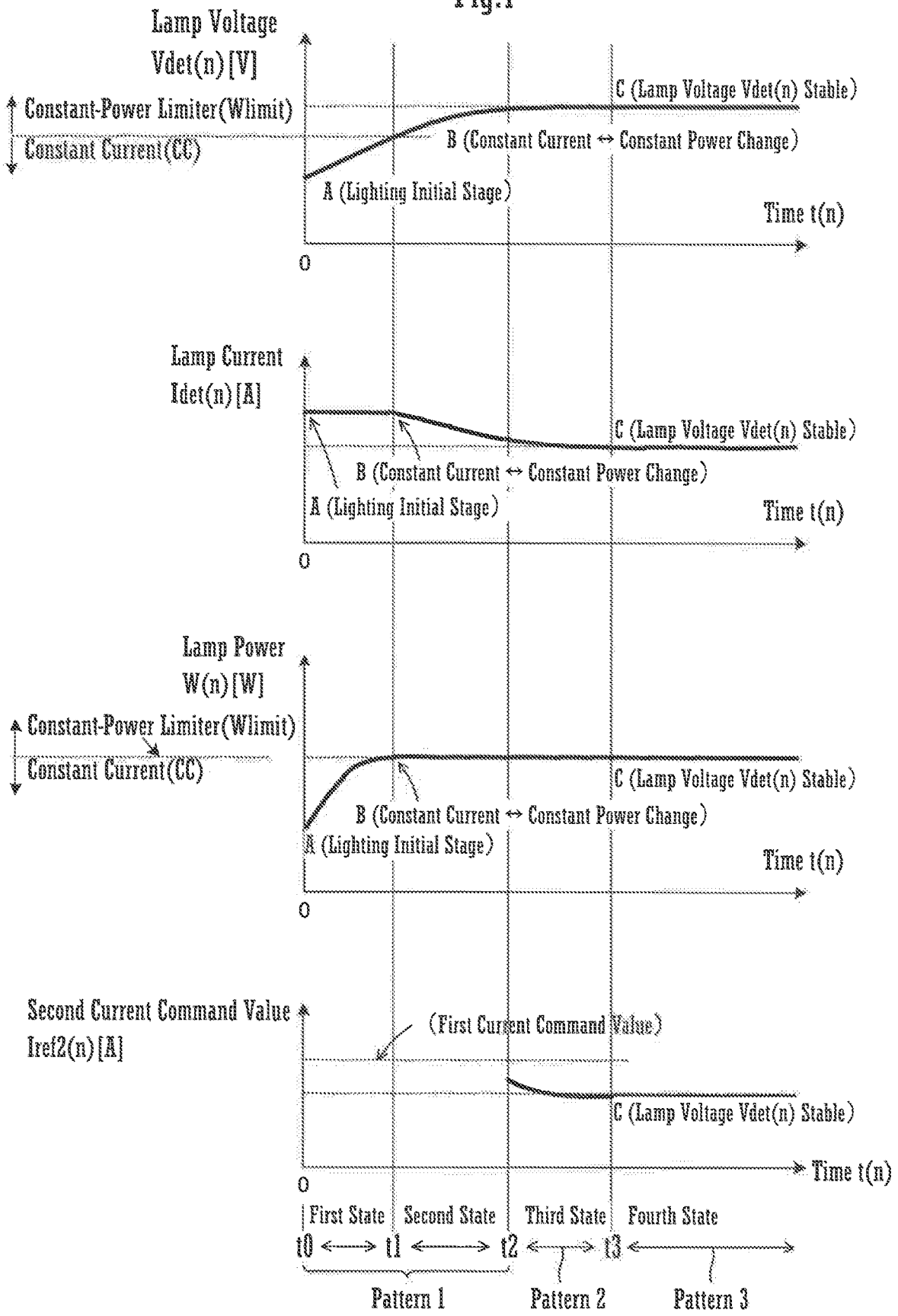
FIG. 7 is a diagram showing a time lapse of a lamp voltage and so forth in a discharge lamp lighting control apparatus according to an embodiment of the present invention.
Figure 8:
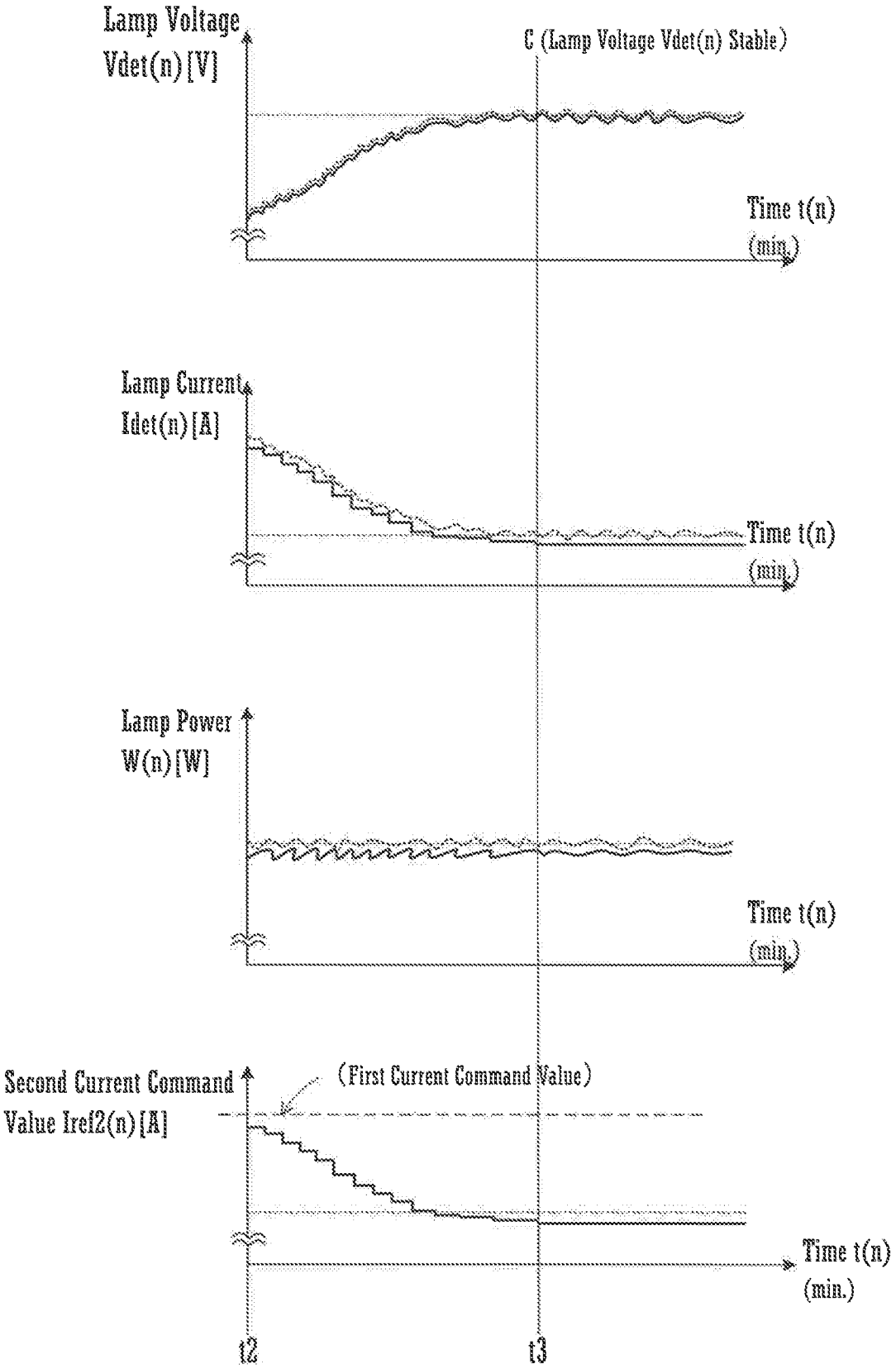
FIG. 8 shows partially enlarged views of FIG. 6 and FIG. 7.

Operations of the discharge lamp lighting apparatus according to this embodiment and the conventional discharge lamp lighting apparatus are explained, referring to FIG. 6 and FIG. 7. FIG. 6 shows a time lapse of the lamp voltage and so forth in the conventional discharge lamp lighting control apparatus. FIG. 7 shows a time lapse of the lamp voltage and so forth in the discharge lamp lighting control apparatus according to this embodiment. FIG. 8 shows partially enlarged views with regard to time axes and voltage axes of FIG. 6 and FIG. 7.

In FIG. 6, from above, temporal changes of the lamp voltage, the lamp current and the lamp power are shown, respectively. Additionally, in the conventional discharge lamp lighting control apparatus, the second current command value is not used.

In the conventional discharge lamp lighting control apparatus, an operation proceeds as described below, as shown in FIG. 6.

When the discharge lamp 12 is turned on at to, a constant-current control is performed using a first current command value that corresponds to a preset rated current (first state). From an initial stage of lighting A after the lamp is turned on with the preset rated current, the lamp voltage keeps on rising. At the time t1 when a constant-power limiter operates as the lamp voltage reaches a rated power Wlimit, the constant-current control is switched over to a constant-power control that uses a constant power command value.

From t1 onward, the constant-power control is performed. In other words, control is performed in such a manner that the lamp current is decreased depending on a rise of the lamp voltage (second state).

Figure 1:
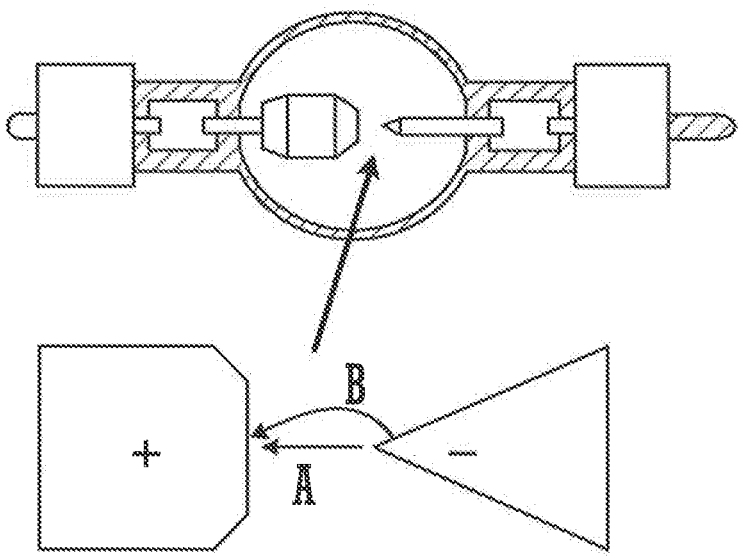
FIG. 1 is a diagram showing a structure of a discharge lamp and an arc.
Figure 2:
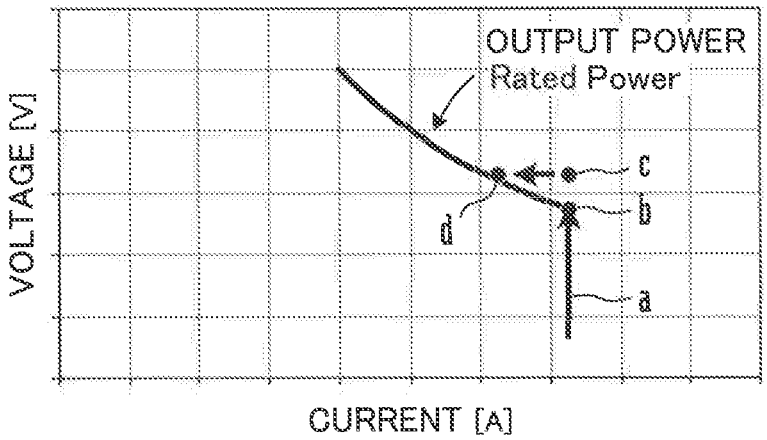
FIG. 2 is a voltage-current characteristic diagram of a discharge lamp lighting control apparatus that performs a constant-current control and a constant-power control.

The constant-power control is maintained even when the state moves into the third state where the rise change value of the lamp voltage becomes less than a certain value at t2. The constant-power control is still maintained even when the state moves into the fourth state after t3 in which the lamp voltage completely stabilizes. The operation characteristic diagram of the above-mentioned control is as shown in FIG. 2, and from t3 onward, the lamp current keeps on fluctuating depending on the fluctuation of the lamp voltage.

In the discharge lamp lighting control apparatus according to this embodiment, an operation proceeds as described below, as shown in FIG. 7.

In FIG. 7, the operation in the first state from when the discharge lamp 12 is turned on at t0 until t1, and thereafter in the second state, is the same as in the case of FIG. 6. That is to say, when the discharge lamp 12 is turned on at t0, a constant-current control is performed using a first current command value that corresponds to a preset rated current (first state). From an initial stage of lighting A after the lamp is turned on with the preset rated current, the lamp voltage keeps on rising. At the time t1 when a constant-power limiter operates, the constant-current control is switched over to a constant-power control that uses a constant power command value.

From t1 onward, the constant-power control is performed. As in the case of FIG. 6, control is performed in such a manner that the lamp current is decreased depending on a rise of the lamp voltage (second state).

From t0 to t2, the operation proceeds in the same manner as in the case of FIG. 6.

At a stage of becoming a third state that is an early stage of the lamp stable state in which the rise change value of the lamp voltage becomes less than a certain value at t2, the first current command value is changed to the second current command value that is smaller than the former when the output power exceeds a predetermined power limiter value due to a rise of the lamp voltage. Using this second current command value, the constant-current control is performed. Further, the second current command value is changed to a smaller value every time the output power exceeds a predetermined power limiter value as a result of a rise of the lamp voltage, and the constant-current control is performed using the second current command value.

In FIG. 8 showing enlarged views of the third state, the solid lines show changes in this embodiment, and the dotted lines show changes in the conventional discharge lamp lighting control apparatus of FIG. 6.

As shown in FIG. 8, in the conventional discharge lamp lighting control apparatus, in the third state between t2 and t3, as the lamp voltage rises, the lamp current fluctuates as shown by the dotted line under the constant-power control. In the discharge lamp lighting control apparatus according to this embodiment, in the third state between t2 and t3, as the lamp voltage rises, the constant-current control is performed with the current command value being changed as shown by the solid line. That is, when the output power exceeds a predetermined power limiter value as a result of the rise of the lamp voltage, the first current command value is changed to the second current command value that is smaller than the former. Using this second current command value, the constant-current control is performed. Further, the second current command value is changed to a smaller value every time the output power exceeds a predetermined power limiter value as a result of the rise of the lamp voltage, and the constant-current control is performed using the second current command value. As shown by the bottom progress diagram in FIG. 8, the second current command value is changed to a smaller value stepwise according to the rise of the lamp voltage. Also, as shown by the lamp power diagram (progress diagram) right above the bottom, since the lamp power remains always less than the rated power, the constant-power control is not performed. With such control, since the lamp current is brought to be constant in each stepwise section during the time period of the third state between t2 and t3, flicker generation can be prevented.

Further, in the fourth state that comes after the third state, since the lamp voltage becomes a completely stable state, the constant-current control is performed using the second current command value having been changed right before t3. After t3, as well, since the constant-current control is performed, there is no flicker generation.

As stated above, in the discharge lamp lighting control apparatus according to this embodiment, during the period of time from t3 at which the rise change of the lamp voltage becomes slow to t4 onward where the lamp voltage stabilizes, the constant-current control is performed with the current command value being decreased depending on the rise of the lamp voltage so that the constant-power control may not be performed.

Figure 3:
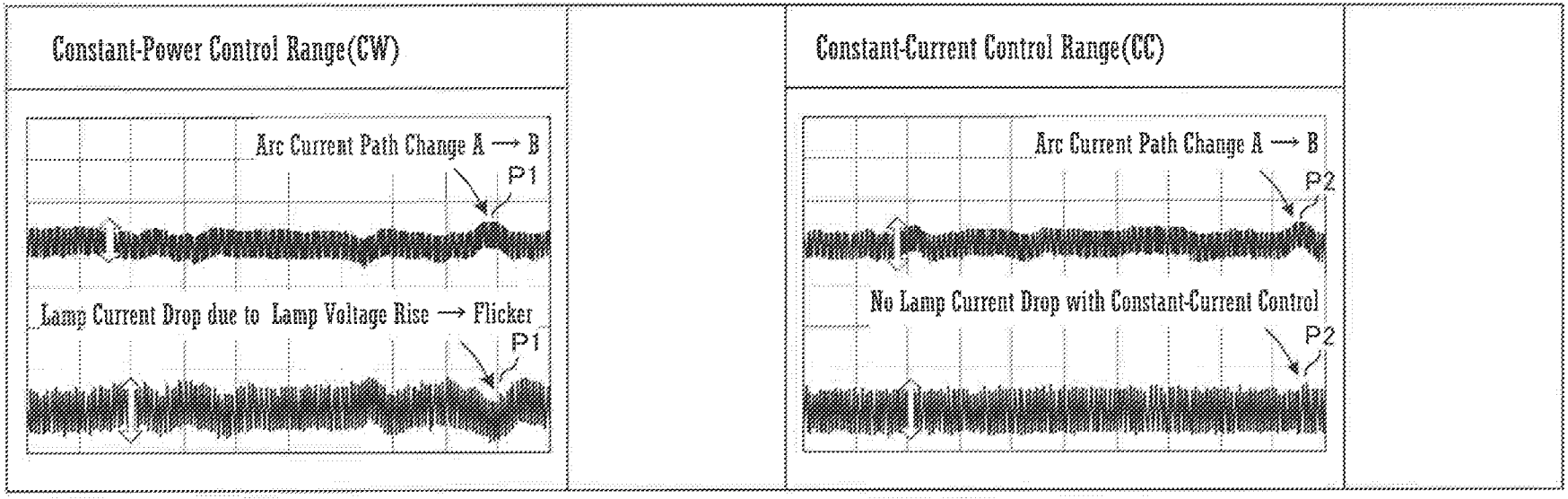
FIG. 3 is a diagram showing a change of a lamp current in a case where the constant-current control is performed when inside of the lamp is in a stable state (waveform on the right side), and a change of the lamp current in a case where the constant-power control is performed when inside of the lamp is in a similarly stable state (waveform on the left side).

On this account, flicker generation can be prevented, as shown by the right part of FIG. 3.

In the following, a concrete explanation of the above-mentioned control content is made, referring to FIG. 9 through FIG. 12.

Figure 9:
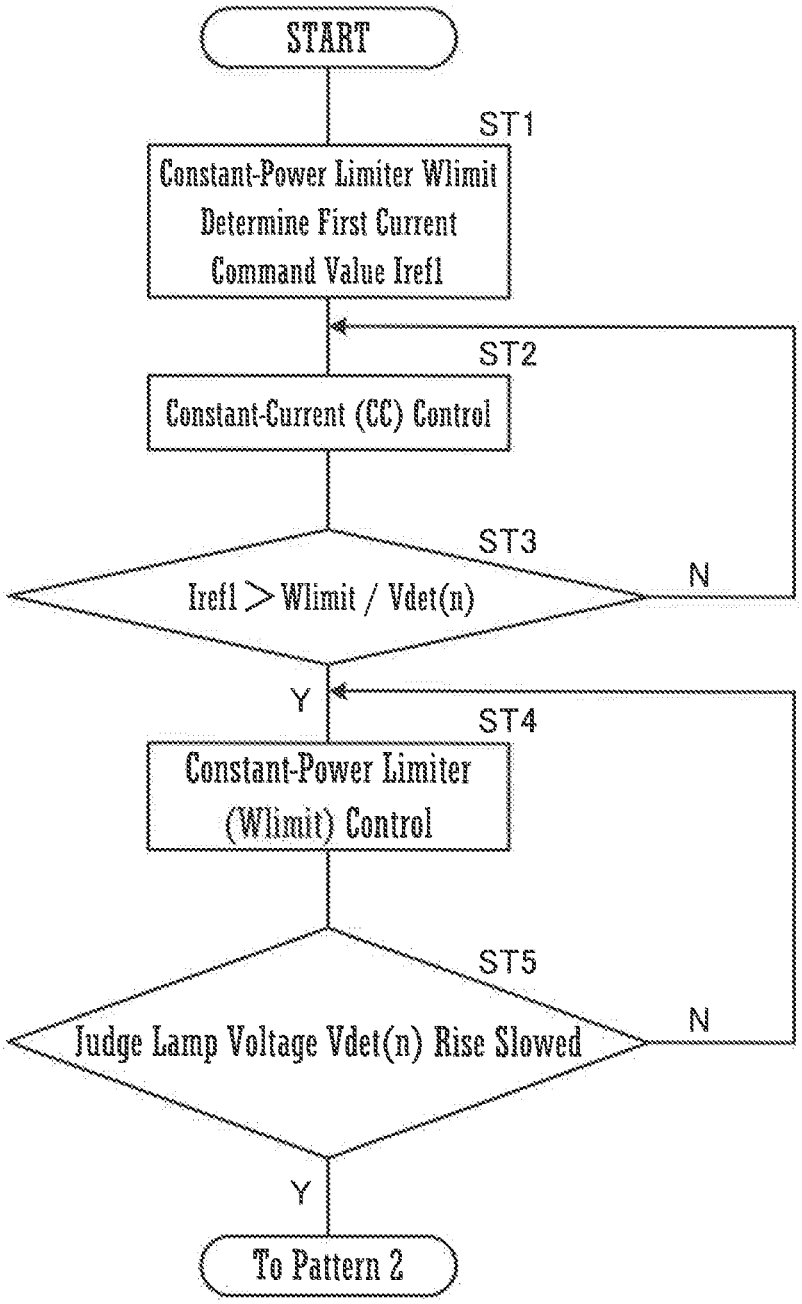
FIG. 9 is a flow chart showing an operation of the discharge lamp lighting control apparatus.
Figure 10:
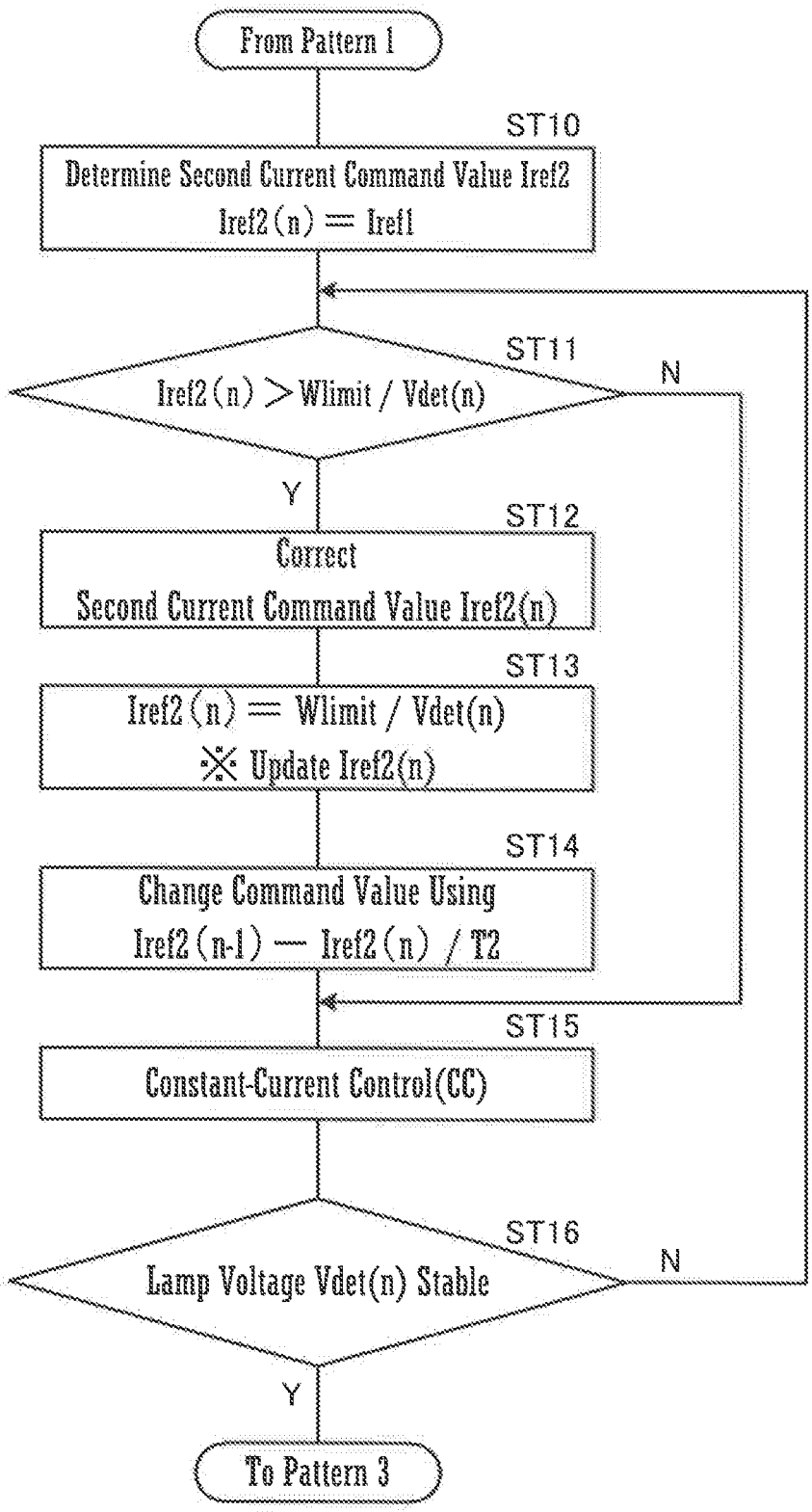
FIG. 10 is a flow chart showing an operation of the discharge lamp lighting control apparatus.
Figure 11:
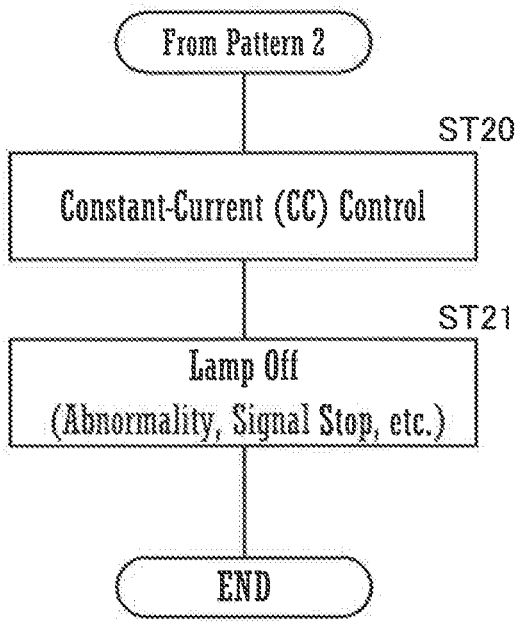
FIG. 11 is a flow chart showing an operation of the discharge lamp lighting control apparatus.

FIG. 9-FIG. 11 are flow charts showing control operations performed by the control portion 111 (see FIG. 5). FIG. 12 is a definition table for the flow chart.

FIG. 9 shows a control operation (Pattern 1) from t0 when the discharge lamp 12 is turned on to t2 when the third state starts (see FIG. 7, FIG. 8). FIG. 10 shows a control operation (Pattern 2) from t2 to t3. FIG. 11 shows a control operation (Pattern 3) from t3 onward.

When the discharge lamp 12 is turned on, at ST1 of FIG. 9, the constant-power limiter Wlimit and the first current command value Iref1 are set by the user. Then, the first state commences, and the constant-current control is performed using the first current command value Iref1 (ST2). Thereafter, when the output power exceeds the constant-power limiter Wlimit (Iref1>Wlimit/Vdet(n)), the second state commences, which results in the progression from ST3 to ST4, and the constant-power control is performed using the constant-power limiter Wlimit.

At t2 when the third state commences in which the rise change value of the lamp voltage becomes less than a certain value (ST5), transition to the control operation of FIG. 10 (Pattern 2) takes place.

At ST10, an initial value of the second current command value Iref2(n) is taken as the value of the first current command value Iref1. At ST11 when the output power exceeds the constant-power limiter Wlimit (Iref2(n) >Wlimit/Vdet(n)), that is, when the lamp voltage Vdet(n) rises, from ST12 onward, a control to change the second current command value Iref2(n) to a smaller value is performed. This correction is carried out at ST13 and ST14 taking a predetermined time. Namely, at ST13, the current value is calculated by dividing the constant-power limiter Wlimit value by the lamp voltage Vdet(n) at that time, and is used as the second current command value Iref2(n) to update. Then, at subsequent ST14, the second current command value is changed gradually from the previous second current command value Iref2(n−1) to the present second current command value Iref2 (n) (the second current command value Iref2 (n) that is obtained at ST12) for a time period of a correction cycle T2. Thereafter, at ST15, using the second current command value Iref2(n), the constant-current control is started.

The above-mentioned control operation is performed as long as the rise of the lamp voltage persists (for the period of time between t2 to t3).

By the way, as shown in FIG. 12, the relationship between the switching cycle of the switching circuit 5, the constant-current control cycle T1 at ST15, and the correction cycle T2 of the second current command value Iref2(n) at ST14 is as follows:

Switching cycle«T1«T2

From the relationship above, the cycle, which is a time period of a correction cycle T2 for which at ST14 the second current command value is changed gradually from the previous second current command value Iref2(n−1) to the presently set second current command value Iref2 (n), is longer than the control cycle. For this reason, as shown by the solid line in the lamp current diagram of FIG. 8, as the lamp voltage stabilizes gradually, so does the time that is taken before changing the next second current command value become longer gradually, and also does the change of the second current command value become smaller; therefore, it is possible to prevent the flicker generation due to the sudden change of the second current command value more effectively.

In the control operation of Pattern 2, when the lamp voltage Vdet(n) is judged stable at ST16, the fourth state that is after t3 onward commences, and transition to the control operation after ST20 onward of FIG. 11 (Pattern 3) takes place.

At ST20, the constant-current control is performed using the second current command value Iref2(n) having been updated last time in Pattern 2. Even if the lamp voltage rises due to the change of the state of the gas and/or the state of the arc in the lamp while the constant-current control is performed, there is no flicker generation because of the constant-current control that is in progress.

When the lamp power supply is turned off at ST21, the control finishes.

With the above-mentioned operations, even when the rise of the lamp voltage occurs in the stable state of the lamp voltage after t2 onward, the state of constant-current control can be maintained by decreasing the second current command value. Therefore, flicker can be prevented from occurring. Also, the constant-current control can be maintained in the state where the lamp voltage is stable without increasing the power supply capacity. Thus, enlargement of the power supply portion can be prevented, and since there is no chance that a power not less than a rated value is supplied to the discharge lamp, there is no risk of reducing the lamp service life.

In the above-mentioned embodiment, a detailed control is performed from the first state to the fourth state; however, the present invention is reducible to performing a constant-current control by changing a current command value to a smaller value in a stable state. Therefore, the present invention includes, for example, another embodiment in which only the control performed in the third state that is shown in the above-mentioned embodiment is performed.

Further, in the above-mentioned embodiment, as an example of the situation where the output power calculated from the first current command value and the lamp voltage V exceeds a predetermined power limiter value, it was shown that the output power exceeds the rated power. However, instead, a predetermined power limiter value may be a power specified by the user.

Moreover, although in FIG. 6, when the discharge lamp 12 is turned on at t0, the constant-current control is performed using a first current command value that corresponds to a preset rated current (first state); instead, a preset rated current may be a current specified by the user.

The invention claimed is:

1. A discharge lamp lighting control apparatus comprising:

an inverter circuit supplying a discharge lamp with a lamp circuit; and a control circuit that performs a constant-current control of the lamp current and outputs a current command value to perform the constant-current control to the inverter circuit, wherein the control circuit performs the constant-current control by changing the current command value to a smaller value in a stable state in which a rise change value of a lamp voltage becomes less than a certain value after the discharge lamp is turned on, wherein the control circuit performs a constant-power control by which an output power becomes a constant power when the output power exceeds a predetermined power limiter value, and outputs a power command value to perform the constant-power control to the inverter circuit; and the control circuit performs the constant-current control in the stable state by changing the current command value to a smaller value when the output power exceeds the power limiter value, wherein the control circuit performs the following control in the order shown below until the lamp voltage stabilizes after the discharge lamp is turned on: (1) performing the constant-current control using a predetermined first current command value in a first state after the discharge lamp is turned on; (2) performing the constant-power control at a stage of becoming a second state in which the output power exceeds the power limiter value due to a rise of the lamp voltage after the first state; (3) performing the constant-current control by changing the current command value from the first current command value to a second current command value that is smaller than the first current command value, when the output power exceeds the power limiter value due to a rise of the lamp voltage, at a stage of becoming a third state in which the rise change value of the lamp voltage becomes less than a certain value after the second state; (4) performing the constant-current control in the third state by changing the second current command value to a smaller value every time the output power exceeds the power limiter value due to a rise of the lamp voltage; and (5) performing the constant-current control when a fourth state in which the lamp voltage stabilizes commences after the third state, using the second current command value having been changed last in the third state.

2. The discharge lamp lighting control apparatus according to claim 1, wherein the control circuit carries out, in the third state, an operation of changing from the first current command value to the second current command value that is smaller than the first current command value, and an operation of changing the second current command value to a smaller value, gradually over a predetermined time.

3. A lamp current supply method for supplying a discharge lamp with a lamp current through an inverter circuit, the method comprising: performing a constant-current control of the lamp current using a predetermined first current command value in a first state after the discharge lamp is turned on; performing a constant-power control in such a manner that an output power becomes a constant power at a stage of becoming a second state in which the output power exceeds a predetermined power limiter value due to a rise of a lamp voltage after the first state; performing the constant-current control using a second current command value that is smaller than the first current command value when the output power exceeds the power limiter value due to a rise of the lamp voltage at a stage of becoming a third state in which a rise change value of the lamp voltage becomes less than a certain value after the second state; performing the constant-current control in the third state by changing the second current command value to a smaller value every time the output power exceeds the power limiter value due to a rise of the lamp voltage; and performing the constant-current control when a fourth state in which the lamp voltage stabilizes commences after the third state, using the second current command value having been changed last in the third state.

* * * * *